United States Patent [19]

Hubert et al.

[11] 4,127,207

[45] Nov. 28, 1978

[54] STACKABLE PLASTIC BOTTLES

[75] Inventors: Guy Hubert, Lasne-Chapelle-Saint Lambert; Charles Vandenhove, Vilvoorde, both of Belgium

[73] Assignee: Societe Bourguignonne d'Applications Plastiques, Chevigny-Saint-Sauveur, France

[21] Appl. No.: 714,272

[22] Filed: Aug. 13, 1976

[30] Foreign Application Priority Data

Aug. 18, 1975 [FR] France ..... 75 25714

[51] Int. Cl.[2] ..... B65D 23/00

[52] U.S. Cl. ..... 215/1 C; 220/69; 215/10

[58] Field of Search ..... 215/1 C, 10, 12 R; 220/69; 150/0.5

[56] References Cited

U.S. PATENT DOCUMENTS

| | | | |
|---|---|---|---|
| 2,076,585 | 4/1937 | Merker | 220/69 |
| 2,960,248 | 11/1960 | Kuhlman | 215/10 |
| 3,480,168 | 11/1969 | Lee | 220/69 |
| 3,542,230 | 11/1970 | Campbell | 215/10 |
| 3,722,725 | 3/1973 | Khetani | 215/1 C |
| 3,747,799 | 7/1973 | Atkinson | 220/69 |
| 3,840,141 | 10/1974 | Allom | 220/69 |
| 3,935,946 | 2/1976 | Bengert | 215/12 R |

FOREIGN PATENT DOCUMENTS

| | | | |
|---|---|---|---|
| 658,699 | 10/1960 | Canada | 215/10 |
| 273,049 | 1/1951 | Switzerland | 215/10 |
| 451,003 | 5/1968 | Switzerland | 150/0.5 |
| 954,454 | 4/1964 | United Kingdom | 150/0.5 |

*Primary Examiner*—Ro E. Hart

*Attorney, Agent, or Firm*—Spencer & Kaye

[57] ABSTRACT

Stackable plastic bottle having a bulging base which is resistant to high internal pressure and which are able for packaging sparkling drinks comprising a base wall and a neck wall provided with an orifice in which the base wall and the neck wall each possess a central zone which, by virtue of a shoulder, projects relative to the peripheral zones of these walls.

24 Claims, 1 Drawing Figure

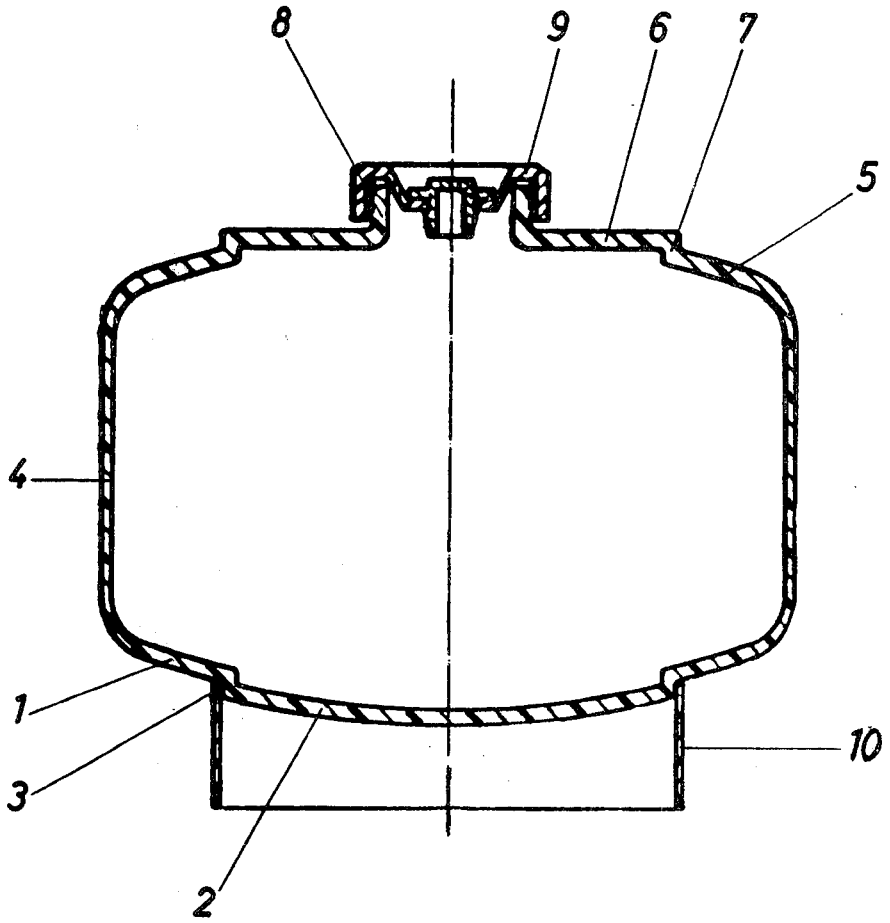
8
9
6
7
5
4
1
3
2
10

STACKABLE PLASTIC BOTTLES

The present invention relates to stackable plastic bottles and more particularly to bottles which have a bulging base which is resistant to high internal pressures, and which are used for packaging sparkling drinks.

Plastic bottles which have a base which bulges and has, for example, a hemispherical shape, are known. These bottles have a markedly greater resistance to internal pressure than that of bottles of which the base is flat or recessed.

In order to be able to be set up vertically, these bottles can be placed on a cylindrical sleeve, produced, for example, from stout cardboard, of sufficient height to reach beyond the lowest part of the base of the bottle. Bottles provided with such sleeves are relatively stable in the vertical position. However, it is not possible to superpose them on one another in a vertical position in order, for example, to store them several layers high, to despatch them on pallets or to display them for retail sale.

Applicants have now found a new shape of plastic bottles which can have a bulging base and which, when they are provided with a sleeve, can be stacked quite safely on top of one another.

Accordingly, the present invention relates to stackable plastic bottles comprising a base wall, a side wall and a neck wall provided with an orifice, in which the base wall and the neck wall each possess a central zone which, by virtue of a shoulder, projects relative to the peripheral zones of these walls.

The invention is illustrated by the single FIGURE in the attached drawing. In this there is shown a view in section along a vertical plane of a bottle according to the invention, provided with a sleeve and a cap. This bottle, of large capacity (5 liters), is intended to contain sweetened carbonated drinks.

The bottle shown in the FIGURE possesses a base wall comprising a peripheral zone 1 and a central zone 2 which projects relative to the peripheral zone 1 and is connected thereto via the shoulder 3. Both the peripheral zone 1 and the central zone 2 are of spherical shape. The base wall possesses symmetry of revolution about an axis which is the axis of the bottle. The side wall 4 is prismatic, of square section. The neck wall comprises a central zone 6 which projects relative to a peripheral zone 5 and is connected thereto via a shoulder 7. An orifice is produced in the neck 8 of the bottle. The said neck is cylindrical, has an external thread and is provided with a screw cap 9. The neck wall also possesses symmetry of revolution about an axis which is that of the bottle, the peripheral zone 5 being plane and the central zone 6 being spherical. The bottle rests on a cylindrical sleeve 10 which is hollow. The base central zone 2 nests therein. The bottle provided with the sleeve 10 can be superposed on another, identical, bottle. The sleeve then nests on the neck central zone 6 of this other bottle. In effect, the cross-section of the base central zone 2 at the level of the shoulder 3 is identical to the cross-section of the neck central zone 6 at the level of the shoulder 7. The height of the sleeve 10 is calculated so that the cap 9 of the underneath bottle rests against the lowest part of the base central zone 2.

Obviously, there are numerous different embodiments of the bottles according to the invention.

Thus, the shape of the section taken along planes perpendicular to the axis of the bottle in the base projecting central zone 2 and neck projecting central zone 6 can be whatever is desired. It can thus have the shape of any plane geometrical figure such as, for example, a rectangle, ellipse, lozenge or parallelogram. However, for reasons of convenience, it is preferred that the general shape of the section should be that of a regular polygon with straight or curvilinear sides, or that of a circle. This latter case is the simplest embodiment. The axis of the bottle is the vertical line which passes through the centre of gravity of the bottle when the latter is in the normal vertical position.

Preferably, the centre of each of the sections in the base central zone 2 and neck central zone 6 is on a straight line which is parallel to the axis of the bottle and preferably coincides therewith.

The profile and shape of the shoulder 3 in the base wall and shoulder 7 in the neck wall can also vary to a large degree. Thus, it is not indispensable that the shoulder should be present over the entire perimeter of the base central zone 2 and of the neck central zone 6. It is sufficient that it is present over at least a segment of this perimeter. Of course, the relative length of the shoulders and their distribution must be so chosen that the base and the neck of the bottle can nest in a sleeve and are efficiently wedged once they have nested. Preferably, the shoulders 3 and 7 run along the entire perimeter of the central zones 2 and 6.

The height of the shoulders 3 and 7 is also not particularly critical; it suffices that nesting in the sleeves should be able to take place correctly. For this, a shoulder of a few millimeters suffices. However, there is no disadvantage, from the point of view of the object of the invention, in employing shoulders of greater height. In practice, shoulders of which the height ranges from 1 to 20 mm are generally used.

According to a preferred embodiment of the invention, the sections of the base shoulder 3 and of the neck shoulder 7, at the level at which they respectively join the base peripheral zone 1 and the neck peripheral zone 5, are situated in parallel planes. More preferably still, these planes are perpendicular to the axis of the bottle.

As regards the rising part of the base shoulder 3 and of the neck shoulder 7, it is preferably perpendicular to the planes of the sections where the shoulders join onto the base peripheral zone 1 and neck peripheral zone 5, or is slightly in the shape of a truncated cone (angle less than 15°), with the join sections constituting the larger base.

The shape of the base central zone 2 is not critical. It can be flat or possess a recess or have starshaped ridges. However, the application of the invention to bottles of which the base central zone 2 bulges is particularly advantageous. Firstly, for a given weight of plastic employed and for a given capacity, these bottles have a markedly greater resistance to internal pressure than that of bottles which, for example, have a flat or recessed base. Furthermore, the bottles according to the invention can easily be provided with a support which holds them in a vertical position when they are used, because of the existence of the projecting base central zone 2. It is for this reason that it is preferred that the base central zone 2 should be bulging. The best results from the point of view of resistance to internal pressure are obtained if this base central zone is spherical.

The shape of the base peripheral zone 1 may also be whatever is desired. Thus, its surface area can be extremely small relative to that of the base central zone 2; it can be reduced to a simple ledge of a few millimeters, sufficient to serve for the sleeve 10 to rest against. In order to optimise the resistance of the bottle to internal pressure, it is also preferred that the base peripheral zone 1 should be of spherical shape.

Equally, in order to improve the stability of the stacked bottles, it is preferred that the surface area of the base peripheral zone 1 should be less than twice the surface area of the base central zone 2. The best results are obtained if the surface area of the base peripheral zone 1 is less than that of the base central zone 2. The surface areas in question are those projected onto a horizontal plane when the bottle is in the normal vertical position.

The shape of the side wall 4 can also be whatever is desired. Thus, it can be cylindrical, prismatic with plane or incurved faces, spherical and the like. It can also, instead of being plane on the external surface, exhibit a relief (rings, tetrahedra and the like). The height of the side wall is also not critical. Preferably, however, it is so chosen that the overall height of the bottle is less than twice the largest transverse dimension. The best results are obtained if this height is less than the largest transverse dimension. Finally, the side wall preferably possesses at least two plane faces parallel to the axis of the bottle. In this way, the plane faces of bottles arranged side-by-side rest against one another and thus improve the stability of the stack. The best results are obtained if the side wall possesses four plane faces parallel to the axis of the bottle and arranged at right angles to one another.

The shape of the neck peripheral zone 5 is also not critical. It exerts practically the same function as the base peripheral zone 1 and anything which has been said in connection with the latter also applies to the former. However, in many cases, because of the presence of a neck, the wall is thicker in the neck peripheral zone 5 than in the base peripheral zone 1. Hence, the spherical shape is less indicated for the former than for the latter.

Equally, the shape of the neck central zone 6 can be whatever is desired. Thus, it can be given a spherical shape. However, the spherical shape is of less value than for the base central zone 2 because the thickness of the wall of the bottle at the level of the neck central zone 6 is frequently greater than at the level of the base central zone 2, as has been stated above.

According to a preferred embodiment of the invention, the shape of the section of the neck central zone 6 is substantially identical to that of the base central zone 2. More precisely, the sections taken at the level at which the neck shoulder 7 and base shoulder 3 join respectively onto the neck peripheral zone 5 and base peripheral zone 1 are identical. When in addition, as mentioned above, the planes of these joins are parallel to one another and perpendicular to the axis of the bottle, the sleeves can have the very simple shape of lengths of tube of internal section corresponding to the external sections of the shoulders.

The bottle orifice is generally produced in an actual neck 8, and opens upwards. This orifice can be located either in the neck peripheral zone 5 or in the neck central zone 6. Usually, however, the orifice is located in the neck central zone 6. The neck wall is so designed as to receive any type of cap, for example screw caps or snap caps.

In order that the bottles according to the invention should have good resistance to internal pressure, it is desirable that the transitions between the various zones should not be abrupt but should take place by means of rounded zones without sharp edges being present.

The bottles according to the invention can be manufactured from any plastic which is suitable for this use and compatible with the products which the bottles are destined to contain. By way of example of such plastics there may be mentioned low density and high density polyethylene, polypropylene, polystyrene, polyvinyl chloride, polyvinylidene fluoride, polyamides, polycarbonate, poly(ethylene glycol terephthalate) or poly(butanediol terephthalate). However, for packaging sparkling drinks or drinks which are sensitive to oxygen, it is preferred to use copolymers of acrylonitrile or of methacrylonitrile in which the content of acrylonitrile or methacrylonitrile predominates, whilst the comonomer can be, for example, styrene or an alkyl acrylate, such as methyl acrylate. These copolymers are frequently grafted onto elastomeric backbones (copolymers of butadiene with, for example, acrylonitrile or an alkyl acrylate) or are mixed with similar grafted copolymers. They are noteworthy for their high impermeability to gases such as oxygen and carbon dioxide.

The bottles according to the invention can be manufactured in accordance with any known process. For example, they can be manufactured by extrusion of a hot tubular parison which is blown in a mould. It is also possible to weld to one another two half-bottles obtained by thermoforming a sheet, or by injection moulding. It is also possible to resort to centrifugal moulding from a plastic powder.

The bottles according to the invention are stacked with the aid of sleeves 10. The shape of the latter can be absolutely whatever is desired, provided that it permits nesting in the base central zone 2 and neck central zone 6. It is thus not essential that the sleeves should be hollow from end to end, though this is their shape in the preferred embodiment because of its economy. If the bottles according to the invention are in accordance with the preferred embodiments, the sleeve can be tubular and can terminate in cross-sections perpendicular to its axis. The internal cross-section of the sleeve must be the same as the external cross-section of the joins between the central zones 2 and 6 and the peripheral zones 1 and 5.

The height and, where relevant, the internal shape, of the sleeve must be such that the base central zone 2 and the neck central zone 7 can seat therein. Preferably, the height is so calculated that the highest part of neck central zone of a bottle rests against the lowest part of the base central zone of another bottle.

The sleeve may consist of any desired material. It is merely necessary that it should resist the mechanical force exerted during stacking. Its thickness must thus be chosen accordingly. For example, it is possible to use sleeves of stout cardboard or of plastic, for example the same plastic as that of which the bottles consist.

If desired, the sleeves can be fixed to the bases of the bottles by any means, for example, crimping, friction, gluing, welding or a snap-fit. They can thus be used as a support when the bottles are in use.

The bottles according to the invention are particularly suitable for packaging sweetened carbonated drinks which must be stored under relatively high pressure. For this application, bottles of large capacity (3 to 10 liters) are used, which can be provided with a means of withdrawing the contents, which can be screwed on in place of the cap. These bottles can not only be stored in high stacks but can also be despatched on pallets of standard sizes and be placed on sale, in this form, in shops having a large floor space. Furthermore, they can easily be chilled in a domestic-type refrigerator.

We claim:

1. Stackable plastic bottles comprising a base wall, a side wall and a neck wall provided with an orifice, characterised in that the base wall and the neck wall each possess a central zone which, by virtue of a shoulder, projects relative to the peripheral zones of these walls, the location where each shoulder joins its respective peripheral zone defines a section, and said sections defined between said shoulders and said respective peripheral zones are substantially identical to one another.

2. Bottles according to claim 1, characterised in that the shoulder between the base central zone and the base peripheral zone joins to the base peripheral zone in a plane parallel to that in which the shoulder between the neck central zone and the neck peripheral zone joins to the neck peripheral zone.

3. Bottles according to claim 2, characterised in that the planes are perpendicular to the axis of the bottle.

4. Bottles according to claim 1, characterised in that the shoulders run along the entire perimeter of the base central zone and neck central zone.

5. Bottles according to claim 1, characterised in that the base central zone or neck central zone has a cross-section in the shape of a plane geometrical figure.

6. Bottles according to claim 5, characterised in that the geometrical figure is a regular polygon with straight or curvilinear sides.

7. Bottles according to claim 5, characterised in that the geometrical figure is a circle.

8. Bottles according to claim 1, characterised in that the base central zone is bulging.

9. Bottles according to claim 8, characterised in that the base central zone is of spherical shape.

10. Bottles according to claim 1, characterised in that the side wall comprises at least two plane faces parallel to the axis of the bottle.

11. Bottles according to claim 10, characterised in that the side wall comprises four plane faces which are at right angles and are parallel to the axis of the bottle.

12. Bottles according to claim 1, characterised in that the surface area, projected onto a horizontal plane when the bottle is in the normal vertical position, of the base peripheral zone is less than twice that of the base central zone.

13. Bottles according to claim 1, characterised in that the overall height of the bottle is less than twice the largest transverse dimension.

14. Bottles according to claim 13, characterised in that the overall height of the bottle is less than the largest transverse dimension.

15. Bottles according to claim 1, characterised in that they are provided with a sleeve in which the base central zone nests.

16. Bottles according to claim 15, characterised in that the sleeve is fixed to the base wall.

17. Bottles according to claim 15, characterised in that the height of the sleeve must be at least equal to that of the base central zone plus that of the neck central zone.

18. Bottles according to claim 17, characterised in that the height of the sleeve is equal to that of the base central zone plus that of the neck central zone.

19. Bottles according to claim 15, characterised in that the sleeve has the shape of a cylinder of revolution.

20. Bottles according to claim 1, characterised in that they are produced from a gas-impermeable plastic.

21. Bottles according to claim 20, characterised in that they are produced from a copolymer of acrylonitrile or of methacrylonitrile with a predominant content of acrylonitrile or methacrylonitrile.

22. Bottles according to claim 21, characterised in that the copolymer is a copolymer grafted onto an elastomeric backbone.

23. Bottles according to claim 21, characterised in that the copolymer is mixed with a copolymer of the same type grafted onto an elastomeric backbone.

24. Bottles according to claim 1, characterised in that they are manufactured by extrusion of a hot tubular parison which is blown in a mould.

* * * * *